United States Patent [19]

Pagnoni

[11] 3,976,219

[45] Aug. 24, 1976

[54] ARTICLE STORING AND DISPENSING UNIT

[76] Inventor: Russell W. Pagnoni, 1306 N. 24th St., Melrose Park, Ill. 60160

[22] Filed: Apr. 28, 1975

[21] Appl. No.: 572,346

[52] U.S. Cl. ..... 221/310

[51] Int. Cl.[2] ..... G07D 1/00; B65D 83/12

[58] Field of Search ..... 221/310, 307, 297, 309, 221/301, 223; 133/1, 6, 8, 5, 5 A

[56] References Cited

UNITED STATES PATENTS

| | | | |
|---|---|---|---|
| 1,225,728 | 5/1917 | Cooley | 221/307 X |
| 3,747,613 | 7/1973 | Westburg | 221/310 |
| 3,765,429 | 10/1973 | Rocheleau | 133/5 A |

*Primary Examiner*—Stanley H. Tollberg

[57] ABSTRACT

An apparatus adapted to receive, orient, and store a plurality of visible markers and to dispense said markers individually in a predetermined location under the control of a user. In one form, the apparatus comprises an upper portion having an enlarged, marker-receiving open end and sidewalls tapering downwardly therefrom, and a body joined to said sidewalls of said upper portion. The body portion is cylindrical and includes a marker inlet opening, a marker dispensing opening and a main body portion between the openings. A plurality of chips or markers are stacked in the body, and a reduced diameter rib or spring disposed within the body portion engages and supports the lowermost marker in the stack of markers. The lower part of the body deflects radially outwardly in response to an axial force to permit passage of a marker past the support and through said discharge opening, permitting an individual marker to be dispensed each time an axial force is applied to the support. The cylindrical body preferably includes axial expansion slots and finger-receiving slots, and in one form, a rotatable slotted transparent cylinder surrounds the body.

11 Claims, 7 Drawing Figures

FIG. 1
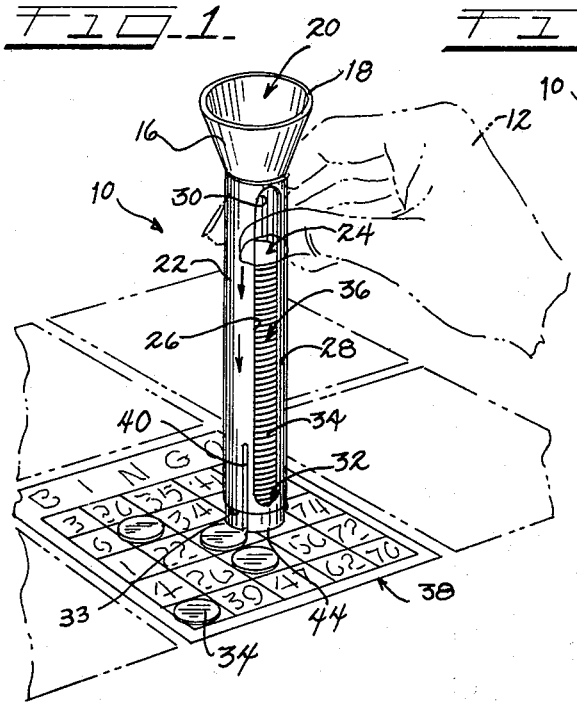
FIG. 2
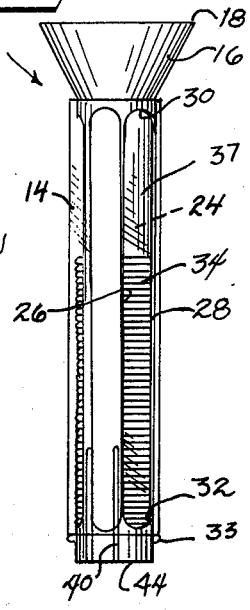
FIG. 3
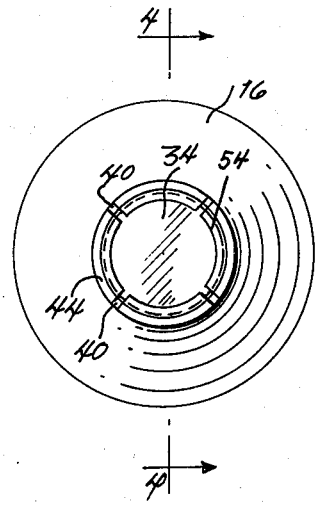
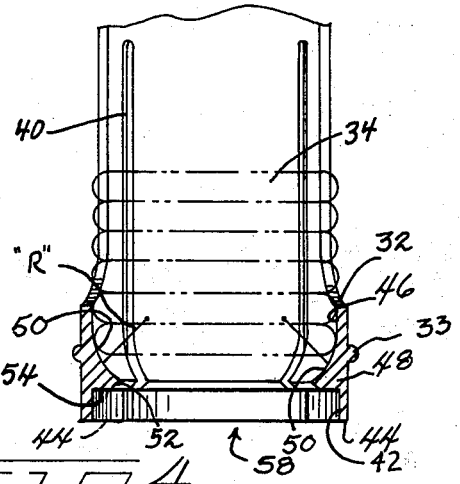
FIG. 4
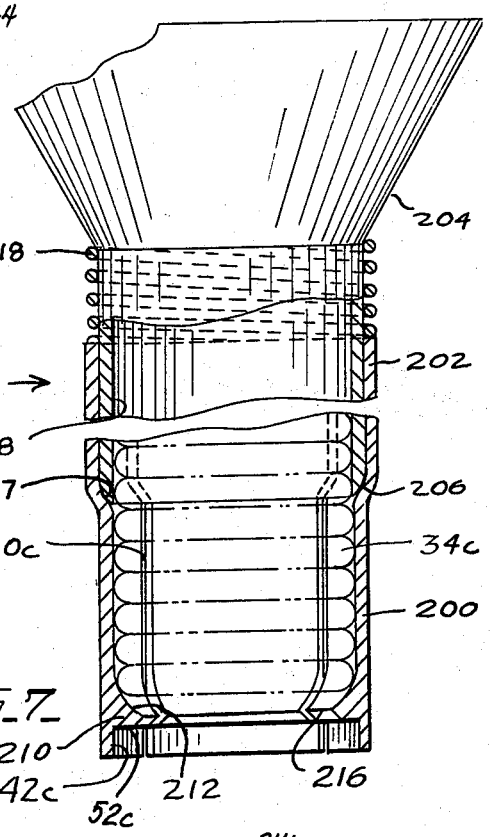
FIG. 7
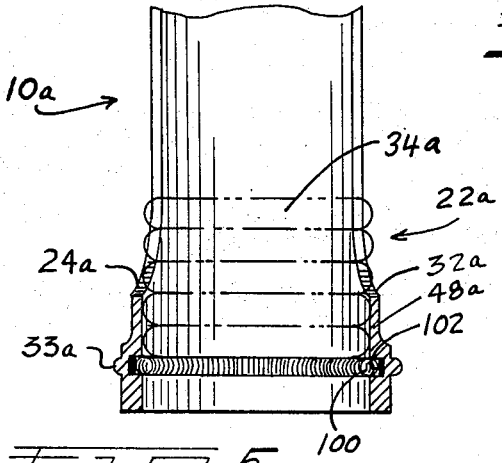
FIG. 5
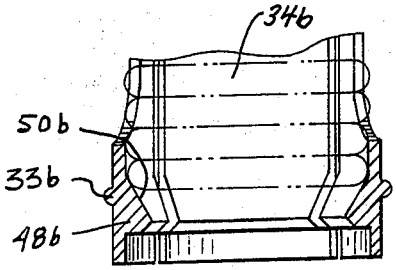
FIG. 6

ARTICLE STORING AND DISPENSING UNIT

The present invention relates generally to dispensers, and more particularly to dispensers adapted to receive and store a plurality of visible markers, and to dispense such markers in a predetermined location, one at a time, under the control of a user.

In one form, the present invention comprehends a dispenser having a marker-receiving area of a generally funnel-shaped form, a marker storage or reservoir area in generally cylindrical form, an outlet portion at the bottom thereof, and means permitting the operator to feed the markers from the discharge end, either by applying a force directly to a stack of markers, or to one part of the dispenser itself. The mechanism is adapted to store and dispense the markers, preferably using the innate resiliency of the cylinder, or, in the alternative, utilizing other resilient means adapted to deflect sufficiently upon application of a dispensing force to permit the marker to be discharged.

One particularly advantageous use of the present invention is as a convenience for, and as a means of assisting, a participant in playing a parlor or chance game such as "Bingo", "Lotto" or "Keeno". The device is particularly useful where a multitude of games are being played simultaneously, and where multiple boards are therefore being used by the player.

As is well known, Bingo and like games of amusement or chance are commonly sponsored and carried out by charitable organizations, such as churches and veteran's groups. In some cases, games are sponsored by fraternal or civic groups at functions such as state and county fairs, etc. In order to minimize waste of material, and to yield a fair rate of return without compromising the ability to make a profit for charitable or other purposes, game operators desire or require the game board or cards to be used repeatedly. Thus, the ordinary expedient of marking by pencil or pen, or with a punching device or the like, is not possible, because such marking or punching will rule out further use of the game cards.

Likewise, whereas certain gaming establishments may use inexpensive, thin paper score cards or sheets, such cards cannot be reused, and it is particularly impractical for non-professional game operators to circulate about the audience and furnish each player with one or more new score sheets each time a new game is to be conducted.

Accordingly, the concept of a reuseable card is considered essential by charitable and other low- or non-profit organizations, and desirable by other sponsoring groups. As a consequence of the foregoing, many game participants, particularly those playing a number of cards, find it necessary to amass an array of markers, such as kernals of corn, coins or other small objects, and, each time a number is called, select one marker from the array and position it as determined by the number or letter calls made by the operator during the course of the game.

Needless to say, it is difficult to manipulate irregular markers, particularly where several cards are played at one time, and where the markers must first be retrieved or obtained from a stack or pile. On the other hand, whereas some players maintain a supply of markers in one hand or the other, the necessity of holding in a supply of markers, particularly irregular ones, can become annoying and inconvenient when the game extends over a significant period of time, such as perhaps an hour or even 2 hours or more. In the past, attempts have been made to facilitate storing, manipulating and dispensing game card markers, but most of such efforts have met with either failure or indifferent success, because they were unwieldy, inaccurate, or required excessive manipulation. The practice of supplying disposable or expendable markers also has certain disadvantages, namely, the tendency of players to expend such markers carelessly or waste them.

In view of the foregoing situation, there has been a need on the part of the game participants for a simple and inexpensive device which would be adapted to receive, orient and store an array of chips or other markers in the form of a stack, thereby positioning the markers such that they can be readily dispensed merely by situating them over the desired marking area and applying a slight downward force to the dispenser or to the topmost marker in the stack or array. There has also been a need for a simple and easily made marking device, capable of the foregoing and other uses, and which requires no moving parts, or a minimum number of moving parts, to operate effectively.

In view of the foregoing, it is an object of the present invention to provide an improved device for marker units.

A further object is to provide a dispenser unit having few, if any, moving parts.

A still further object is to provide a dispenser which includes means for forming a plurality of markers into a stack or other formation from which they may be readily and accurately dispensed.

A still further object is to provide a dispenser wherein markers or other objects may be individually dispensed by applying a small but definite push or force to the topmost marker in the stack of markers received within the device.

A still further object is to provide a dispenser unit having openings permitting access by the fingers to a stack of markers disposed in the dispenser, and also having a sleeve surrounding the dispenser which has both open and closed areas, and which is rotatable between positions so as to close the openings for loading in one position, and to provide access to the openings in the other position so that the fingers may be used to dispense the markers from the unit.

Another object is to provide a dispenser having a generally cylindrical body portion and which includes means permitting the lower portion of the dispenser body to be forced outwardly apart during dispensing, and to return to a closed position against the innate resiliency of the cylinder.

A further object is to provide a dispenser which includes means for supporting a stack of markers, in the form of an annular formation of reduced diameter and characterized by a radiused, partially upwardly directed surface.

Another object is to provide a dispenser wherein the means supporting the stack of markers is in the form of an annular spring disposed within a groove adjacent the lower portion of the body.

A still further object is to provide a form of dispenser having inner and outer sleeves, and constructed and arranged so that the axial movement of one sleeve relative to the other causes the lower portion of one sleeve to expand, to permit a marker to be dispensed from the unit.

Another object is to provide a dispenser which will receive, orient, and store an array of disc-like markers, and dispense them by overcoming the resiliency of an annular formation located adjacent to the lower portion of the dispenser.

These and other objects and advantages of the invention, including those inherent therein, are accomplished by providing a dispenser unit having means for receiving, orienting, and storing a plurality of markers in a stacked formation, means adapted to engage the lowermost marker in the stack, and adapted to be deflected to an enlarged diameter under application of load, to permit dispensing of the marker on application of a force to the stack or the unit itself to permit the markers to be dispensed individually.

The manner in which the foregoing objects and advantages are carried into practice will become more clear when reference is made to the following detailed description of the preferred embodiments of the invention set forth by way of example, and shown in the accompanying drawing, wherein like references indicate corresponding parts throughout, FIG. 1 is a perspective view of one form of a dispenser made according to the invention, showing the dispenser in position of use above a game board;

FIG. 2 is an elevational view of the dispenser of FIG. 1 showing the dispenser surrounded by a sleeve useful in loading the dispenser;

FIG. 3 is a bottom view of the dispenser unit of FIGS. 1 and 2;

FIG. 4 is a vertical sectional view, on an enlarged scale, showing the lower portion of the form of dispenser shown in FIGS. 1–3 the outer sleeve shown in FIG. 2 being omitted;

FIG. 5 is a vertical sectional view, on an enlarged scale, of the lower portion of an alternate form of dispenser unit made in accordance with the invention;

FIG. 6 is an enlarged vertical sectional view of the lower portion of a modified form of the dispenser shown in FIGS. 1–4; and FIG. 7 is an enlarged vertical sectional view, with portions broken away, showing a still further modified form of the dispenser of the invention.

While it will be understood that the dispenser unit of the invention is capable of other uses, the forms illustrated herein show a dispenser adapted to dispense markers or chips on one or more game boards arrayed in front of the user.

Referring now to the drawings in greater detail, the invention is shown in FIGS. 1 and 2 to be embodied in a dispenser generally designated 10 and adapted for reception in the hand 12 of the user. A transparent sleeve 14 surrounds the dispenser 10, for purposes which will appear. The dispenser 10 includes a generally frusto-conicaly shaped upper portion 16 having a top rim 18 defining a marker-receiving opener 20.

A body portion generally designated 22 is of cylindrical form and includes means in the form of a pair of cutouts generally designated 24, for providing access to the edges of the markers by the fingers of the user. The cutouts 24 are defined by vertical edges, 26, 28 and by top and bottom edges 30, 32, respectively. A plurality of markers 34 are shown to be received in a stacked formation 36 within the body 22; markers 34 previously dispensed are shown to be resting in various squares of a "Bingo" or other type game board 38.

As shown in FIGS. 1 and 2, the unit 10 includes one or more relatively long vertical slots 40, spaced 90° circumferentially from each other (FIG. 3) and extending upwardly from the lower margin 44 of the dispenser 10 into the dispenser body 22.

Referring now to FIG. 4, it will be noted that the inner surface 46 of the body 22 includes means in the form of an annular formation 48 for retaining the markers against downward movement, with the annular formation 48 having a curved or radiused, upwardly and outwardly directed surface 50 which is adapted to receive and support the outer, lower edge surfaces of the lowermost marker 34 in the stack of markers 34 received in the body 22. Beneath the radiused surface 50 is a tapered surface 52 partially intersecting a radial defining shoulder surface 54. Beneath the shoulder 54 is a cylindrical surface 42 which is of enlarged diameter with respect to the diameter of the markers 34, thus insuring that a marker 34 will not be retained within the body 22 beneath the surface 52.

Referring again to FIG. 2, it will be noted that the transparent sleeve 14 encircles the body 22 of the dispenser. This sleeve 14, which is a feature of one form of the invention, is also provided with finger cutouts and vertically extending slots similar or identical to those cutouts 24 and slots 40 in the body 22 of the dispenser 10, for purposes which will appear herein. Means in the form of outwardly directed bosses 33 on the lower portion 48 of the body 22 serve to support the sleeve 14 to prevent it from falling axially downwardly, and to permit the sleeve 14 to be rotated about the axis of the body 22. The sleeve 14 is sized so as to be readily rotatable with respect to the body 22. In use, the imperforate or closed off portions of the sidewalls 37 of the sleeve 14 are used during loading to cover the cutouts 24 in the body 22 of the dispenser 10, thus preventing the markers 34 from falling outwardly from the cutouts 24.

Referring now to the operation of the form of device shown in FIGS. 1–4, it will be assumed that a player is in possession of a plurality of markers or chips 34, and wishes to prepare to participate in a game of "Bingo"or the like.

The dispenser 10 is grasped by the user, and the sleeve 14 is rotated such that the sidewalls 37 thereof cover the cutouts 24 in the dispenser body. Thereupon, a plurality of disc-shaped markers 34 are "poured" into the frusto-conical upper portion 16 through the opening 20. The conical shape of the portion 16 serves to orient or direct the markers in an orderly manner into the lower or body portion 22 of the apparatus 10, arranging them in a properly arrayed or stacked formation 36. The markers continue to be inserted until a desired number comprises the stack, with the stack preferably stopping some one-half to 1 inch below the upper margin 30 of the cutout finger slot 24. Thereupon, the lowermost marker 34 in the stack 36 is supported against vertical movement by the radiused surface 50 of the annular formation 48.

Assuming now that the game is about to commence, the participant rotates the sleeve 14 about its own axis, thereby moving the cutouts in the sleeve 14 into registry with the cutouts 24 in the body 22. The player then grips the body 22 such that, on one side of the body 22 the thumb extends into the cutout 24, and on the other side of the body 22, the second and/or third fingers extend through the cutout 24. In this way, the user both supports the dispenser 10 and engages the edges of the markers 34 with the thumb and other fingers, respectively.

When a number is called which appears on any one or more of the participant's cards 38, the lower portion 44 of the dispenser 10 is placed against or just above such number on the card 38, and the fingers and thumb are used to exert a slight downward pressure on the uppermost marker in the stack 36. This force is transmitted downwardly through the stack, and, because of the radius or bevel on the surface 50, tends to separate the slots 40 into a more widely spaced position, biasing the walls slightly apart and permitting one marker to be dispensed from the outlet opening 58 defined by the lower margins 44 of the dispenser body 22.

Upon relaxation of the force, the walls return to their unstressed position, with the remaining markers continuing to be supported within the body 10. The action is repeated as often as desired, with a slight downward push being all that is required to dispense an individual marker. Inasmuch as the unit is adapted to hold a large number of markers, and by reason of the simple manipulation required to dispense a marker or chip, increased accuracy in card marking is achieved without damaging or destroying the cards. Because of the rapid and simple manner of dispensing the marker, the game is made more enjoyable to the participant.

Referring now to FIG. 5, another form of the invention is shown in the form of an apparatus 10*a* for dispensing markers 34*a* which includes a body portion 22*a*, a pair of cutouts 24*a* having a bottom edge 32*a*, and a plurality of sleeve-locating bosses 33*a*. The upper portion of the unit 10*a* is the same as the upper portion of the unit 22 shown in FIGS. 1–4, for example, and these parts being similar to such embodiment, further description thereof is not necessary.

However, the lower portion of the apparatus 10 differs from the earlier forms in that the means normally supporting and preventing downward movement of the chips or markers is in the form of a combination garter spring 100 and a groove 102 receiving the spring as shown, i.e., with the inner surfaces of the spring 100 engaging the exterior surfaces of the markers 34*a*. The increased thickness of the lowermost portion 48*a* of the dispenser body permits the groove 102 to be cut to a suitable depth. While vertical slots corresponding to the slots 40 in FIGS. 1 and 2 are not shown as being provided in this form of the invention, it will be understood that the slots may be provided if all the necessary deflection is not to be taken up by the spring 100.

In this form, the garter spring is selected so as to have an inside diameter just less than that of the outside diameter of the marker. The groove is sized such that the garter spring fits radially very snugly therein, so that the radial load is transferred directly to the lower body portion 48*a*. Accordingly, when the edges of the markers 34*a* engage the spring, the markers will be retained against movement. However, applications of a suitable downward force will transmit a radial force to the lower portion of the cylinder, causing the walls to expand and permitting one marker to be dispensed. As the marker or chip passes the spring unit 100 the spring contracts by virtue of its innate resiliency so as to prevent movement of the succeeding marker downward. Subsequent application of force causes the cycle to be repeated; however, the action thus provided affords a good "feel" and accurate dispensing operation. By reason of the rounded contours of the cross section of the garter spring and the rounded edges of the markers, there is only a thin line of contact between the springs and the markers when the spring is supporting the marker units. This prevents any tendency of the markers to jam during feeding or to dispense in groups rather than individually.

Referring now to FIG. 6, a form of dispenser for markers 34*b* is shown wherein the surface 50*b* lying inside the lower portion 48*b* of the dispenser body is tapered or beveled instead of being radiused or rounded such as its counterpart surface 50 in FIG. 4. In other essential respects, including provision of the sleeve-supporting bosses 33*b*, the device of FIG. 6 is similar to that of the device of FIGS. 1–4.

Referring now to FIG. 7, a form of dispenser 10*c* is shown wherein the markers 34*c* are retained within the lower portion 200 of an exterior sleeve 202, and wherein downward forces on the frusto-conical, marker-receiving or loading portion 204 will cause the marker 34*d* to be dispensed. In this form, as will appear, a tapered lower edge 206 of an inner sleeve 208 acts against a tapered surface 207 in the outer sleeve 202 to spread it and permit the markers 34*c* to be dispensed.

In this form, the lower part 200 of the outer sleeve 202 has an annular formation 210 therein, which includes a radiused or beveled surface 212, supporting the lower, outer edge of a marker 34*c*. The marker or chip 34*c* is thus supported much in the manner of its counterpart shown in FIG. 4. Vertical slots 40*c* are provided in the lower portion 200 of the outer sleeve 202, permitting the lower portion 200 to deflect outwardly under load and then return to an unstressed position by reason of its innate resiliency. An enlarged diameter portion 42*c* of the sleeve 202 is defined in part by a tapered surface 52*c* lying beneath the edge 216 of the annular rib 210.

In use, movement of the inner sleeve 208, by reason of the wedging action between the respective tapers 206 and 207, will spread the lower portion 200 of the outer sleeve 202, permitting a marker 34*c* to be dispensed from the unit. FIG. 7 shows optional means in the form of a spring 218 normally biasing the inner sleeve 208 upwardly in respect to the outer sleeve 202, and into a static position wherein the lower portion 200 of the outer sleeve 202 remains in its relaxed or contracted position with the beveled surface 212 supporting the markers 34*c*.

In this form, because the dispensing is accomplished by pushing downwardly on the loading cone 204 or other part of the dipenser itself, rather than upon the markers, both the inner and outer sleeves 208,202 may be free of cutouts or finger slots.

In the operation of this form, the markers are loaded by being poured into the hopper or loading cone 204, and are formed into a stack or array within the sleeves 208,202. The dispenser 10*c* is grasped by the cone 204, and when it is desired to dispense a marker the cone 204 is moved downwardly, against the force of the spring 206, thereby separating the outer sleeve and permitting the chip to be dismissed.

Referring now to certain preferred forms of the invention, an embodiment in which the body 22 has a height of from about 5 inches to about 8 inches and an outside diameter of about 13/16 of an inch has proved satisfactory. In this form, the sidewalls of the cone 16 are inclined about 40° from the vertical, the inside diameter of the body is approximately 0.755 inches, and the inside diameter of the sleeve where the beveled surfaces 50,52 meet is about 0.700 inches in diameter.

The diameter of the surface 42 is about 0.765 inches in this form of unit.

In one preferred form, the lower portion of the annular formation 48 is about 0.05 to 0.10 inches above the bottom edge 44, while the bosses or partial ribs 33 are from about 0.50 to about 0.62 inches above the surface 44 and have a height of 0.003 to 0.01 inches. The slots 40 may be 1 to 2 inches in height, and in the form shown in FIG. 7, for example, should extend well above the tapered surfaces 206,207 to permit the outer sleeve to flex in this area.

The outer sleeve 14 is preferably made from a transparent material such as an acrylic plastic, or polyethylene, for example. The sleeve 14 is sufficiently resilient to be able to deflect over the bosses 33, but is able to be retained thereover. The slight working clearance between the sleeve 14 and the body 22 permits the sleeve 14 to remain in the position to which it is indexed, while still requiring a certain amount of intentional force to rotate it.

The markers 34 preferably have beveled or radiused edges, and may be made from a transparent material so the numbers beneath them may be easily seen.

In the preferred form of apparatus shown in FIG. 4, the reference radius line R is intended to illustrate that an angle of 60° is sub-tended by the arc or radius of the surface 50.

The body 22 and the loading cone 16 are preferably integrally formed in a single piece, and may be made of a resilient aluminum alloy, of steel, or of a plastic material having an innate resiliency. The transparent sleeve 14 permits the user to view the stack of markers 34 being assembled in the body 22 when the device is being loaded, so that loading may be interrupted if it is necessary to re-align the markers. The device may be manufactured by machining, molding, or otherwise.

While the invention has been illustrated as being useful for marking cards in games and the like, other uses thereof will occur to those skilled in the art. For example, it can be useful in playing other games, in making charts or exhibits, as an illustration in teaching, particularly in illustrating locations or in counting exercises, etc.

It will thus be seen that the present invention provides a new and useful dispenser unit having a number of advantages and characteristics, including those pointed out herein and others which are inherent in the invention. The several preferred embodiments only having been described in detail by way of example, I contemplate that variations and modifications of the present invention will occur to those skilled in the art, and I anticipate that such variations and modifications may be made without departing from the spirit of the invention or the scope of the appended claims.

I claim:

1. An apparatus adapted to receive, orient, and store a plurality of visible markers and to dispense said markers individually in a predetermined location under the control of a user, said apparatus comprising, in combination, an upper portion having an enlarged, marker-receiving open end and sidewalls extending downwardly therefrom, a body portion joined to said sidewalls of said upper portion, said body portion including means defining a marker inlet opening, a marker dispensing opening and a main body portion intermediate said openings, said body portion being adapted to store therein a plurality of said markers in stacked formation, means of reduced diameter disposed within said intermediate body portion, said reduced diameter means being adapted to engage and support the lowermost marker in said formation, said support means being adapted to deflect radially outwardly in response to an axial force to permit passage of a marker past said support means and through said discharge opening, said main body portion including wall surfaces having therein a pair of axially extending, finger receiving slots, said slots being sized to expose edge portions of said markers, whereby the fingers of a user may exert said axial force on said marker support means by applying force to said marker formation and an individual marker may be dispensed each time axial force is applied to said support means.

2. An apparatus as defined in claim 1 wherein said body portion includes at least one slot extending axially from said dispensing opening into said main body portion and above said marker support means, thereby facilitating said radially outward deflection of said support means.

3. An apparatus as defined in claim 1 in which said marker support means is in the form of an annular rib having a downwardly and inwardly extending surface formed on a radius, said surface defining said means of reduced diameter which constitutes said marker support means.

4. An apparatus as defined in claim 1 wherein said marker support means is in the form of an annular rib disposed within said body portion, said rib having a frusto-conical surface extending downwardly and inwardly to define said means of reduced diameter which constitutes said marker support means.

5. An apparatus as defined in claim 1 wherein said sidewalls of said upper portion define marker orienting means of frusto-conical shape.

6. An apparatus adapted to receive, orient, and store a plurality of visible markers and to dispense said markers individually in a predetermined location under the control of a user, said apparatus comprising, in combination, an upper portion having an enlarged, marker-receiving open end and sidewalls extending downwardly therefrom, a body portion joined to said sidewalls of said upper portion, said body portion including means defining a marker inlet opening, a marker dispensing opening and a main body portion intermediate said openings, said body portion being adapted to store therein a plurality of said markers in stacked formation, means of reduced diameter disposed within said intermediate body portion, said reduced diameter means being adapted to engage and support the lowermost marker in said formation, said support means being adapted to deflect radially outwardly in response to an axial force to permit passage of a marker past said support means and through said discharge opening, said body portion including at least one slot extending axially from said dispensing opening into said main body portion and above said marker support means, thereby facilitating said radially outward deflection of said support means, said body portion further including wall surfaces having a pair of axially extending, finger-receiving slots, said slots being sized to expose the edge portions of said markers, whereby the fingers of a user may exert said axial force on said support means by applying said force to said marker formation and an individual marker may be dispensed each time said axial force is applied to said support means.

7. An apparatus as defined in claim 6 which further includes a cylindrical sleeve surrounding said body portion and sized for snug but rotatable fit relative to said body portion, said sleeve having finger-receiving openings and at least one slot thereon, said openings and said slot corresponding generally in size and location to said finger openings and slot in said body portion of said apparatus.

8. An apparatus as defined in claim 7 wherein said sleeve is made from a transparent material.

9. An apparatus adapted to receive, orient, and store a plurality of visible markers and to dispense said markers individually in a predetermined location under the control of a user, said apparatus comprising, in combination, a loading cone portion having an upper margin defining a marker-receiving opening, and a lower margin of reduced diameter, frusto-conical sidewall portions extending downwardly and inwardly from said upper margin to said lower margin, a cylindrical body portion with its upper end joined to the lower margin of said sidewall and its lower end terminating in a bottom edge portion defining a marker-dispensing opening, at least one axial slot cut through said body and extending upwardly from said bottom edge portion, a pair of finger-receiving openings extending generally axially of said body and terminating respectively at points spaced apart from said upper and lower ends of said body, said finger openings providing exposure of the edge portions of a plurality of markers received within said body in stacked formation, a generally annular formation disposed on the inner surfaces of said body and spaced apart from said bottom edge of said body, said annular formation including a downwardly and inwardly extending surface having a reduced diameter portion adapted to support the lowermost marker in a stack of markers, said lower end portion of said body adjacent said slot being adapted to flex radially outwardly in response to an axial force applied to said supporting surface of said body portion through said markers, whereby an individual marker may be dispensed from said apparatus by applying an axial force to said marker stack, thereby deflecting said body portion adjacent said slot outwardly to an extent sufficient to permit passage of said marker past said reduced diameter portion of said body axially outwardly from said dispensing opening.

10. An apparatus as defined in claim 9 which further includes a cylindrical sleeve surrounding said body portion and sized for snug but rotatable fit relative to said body portion, said sleeve having finger-receiving openings and at least one slot therein, said openings and said slot corresponding generally in size and location to said finger openings and slot in said body portion of said apparatus.

11. An apparatus as defined in claim 10 wherein said sleeve is made from a transparent material.

* * * * *